US009454867B2

(12) United States Patent
Jin

(10) Patent No.: US 9,454,867 B2
(45) Date of Patent: Sep. 27, 2016

(54) AUTOMATIC FOOD AND BEVERAGE VENDING MACHINE

(75) Inventor: Xukai Jin, Beijing (CN)

(73) Assignee: Shenzhen tianyi original invention technology Co., LTD, Shenzhen, Guangdong (CN)

( * ) Notice: Subject to any disclaimer, the term of this patent is extended or adjusted under 35 U.S.C. 154(b) by 125 days.

(21) Appl. No.: 14/370,060

(22) PCT Filed: Aug. 28, 2012

(86) PCT No.: PCT/CN2012/080643

§ 371 (c)(1),
(2), (4) Date: Aug. 26, 2014

(87) PCT Pub. No.: WO2013/107179

PCT Pub. Date: Jul. 25, 2013

(65) Prior Publication Data

US 2014/0367402 A1 Dec. 18, 2014

(30) Foreign Application Priority Data

Jan. 18, 2012 (CN) ..... 2012 1 0015030

(51) Int. Cl.
*G07F 11/16* (2006.01)
*G07F 17/00* (2006.01)
*G07F 11/42* (2006.01)

(52) U.S. Cl.
CPC ..... *G07F 11/16* (2013.01); *G07F 11/42* (2013.01); *G07F 17/0064* (2013.01)

(58) Field of Classification Search
CPC ..... G07F 11/16
See application file for complete search history.

(56) References Cited

U.S. PATENT DOCUMENTS 4,270,319 A * 6/1981 Spasojevic ..... B60P 3/0257 296/22
6,564,964 B2 * 5/2003 Johnson ..... G07F 11/42 221/129
6,830,160 B2 * 12/2004 Risolia ..... G06Q 30/0252 221/3
8,121,727 B2 * 2/2012 Mosey ..... G07F 9/105 221/131
8,162,174 B2 * 4/2012 Hieb ..... G07F 11/165 221/122

FOREIGN PATENT DOCUMENTS

CN 2567699 Y * 9/2002 ..... G07F 11/16

* cited by examiner

*Primary Examiner* — Leslie A Nicholson, III
*Assistant Examiner* — Ayodeji Ojofeitimi

(57) ABSTRACT

An automatic food and beverage vending machine includes: a case; an ordering and billing system; an electronic control system; and an output system; wherein the output system comprises a food provider and a food outlet, the food provider is mounted in a food storage area of the case; the food provider comprises a tray holder, a food box transporter, and a sliding device; the tray holder and the food box transporter are mounted on the sliding device; the sliding device comprises an up-down sliding mechanism, a left-right sliding mechanism, and a front-rear sliding mechanism; the food outlet is provided on a door of the case. The machine provides a small volume, a small land occupation space, convenience of moving, a short time before obtaining the food, a proper food temperature for eating immediately, and a quick manner of dining for people in a hurry.

8 Claims, 7 Drawing Sheets

AUTOMATIC FOOD AND BEVERAGE VENDING MACHINE

CROSS REFERENCE OF RELATED APPLICATION

This is a U.S. National Stage under 35 U.S.C 371 of the International Application PCT/CN2012/080643, filed Aug. 28, 2012, which claims priority under 35 U.S.C. 119(a-d) to CN 201210015030.0, filed Jan. 18, 2012.

BACKGROUND OF THE PRESENT INVENTION

1. Field of Invention

The present invention relates to a technical field of vending machines, and more particularly to an automatic vending machine with a heat insulation function for rapidly selling fast foods and beverages.

2. Description of Related Arts

The conventional vending machines are mostly for selling beverages. After inserting banknotes or coins, the customer selects a desired beverage. Then the beverage rolls from an internal repository to a bottom outlet of the vending machine through a tunnel. However, the structure is not suitable for selling fast food.

Fast food is mainly for the modem fast-paced people who require nutrition, taste and convenience. A conventional method is running a restaurant. Although the conventional restaurants have a variety of styles, levels and tastes, and are basically able to satisfy the customers, the conventional restaurants still have the disadvantages of low efficiency, crowded seats and far distances. In addition, most customers want to eat delicious foods with a proper temperature at any time, while the conventional restaurants are not able to provide foods anytime and anywhere. Besides, if the customer needs to quickly finish the meal because of facing a transfer during a trip or lacking time, even the nearest fast food restaurant is not able to immediately provide the foods. For the issue, a self-service fast food vending machine was designed and applied for patent. The self-service fast food vending machine, whose application number is CN201110043374.8, comprises: a food supply and storage system, a food thermal insulation and moisture system, a food heating system, an ordering and billing system, and a food sorting and output system, which are connected to an external power source through a wire. Fast foods are pre-stored in the vending machine by an operator, and a thermal insulation and moisture environment is maintained. After the customer orders and pays for a food, the ordered food is sorted and sent to the food heating system. Then the heating system is activated and is controlled by a thermostat or a delay control switch. The food is outputted after satisfying eating requirements, in such a manner that the self-service fast food is produced and provided for the customer. The foods stored in the machine should be pre-cleaned and processed in a semi-finished or finished form. The foods provided and packages thereof can be various. In the meantime, the self-service fast food vending machine can be simplified and converted into a coin-operated food heating machine. The heating function can be expanded, and a security function as well as an advertising function can be added. The self-service fast food vending machine can be placed in office buildings, industrial parks, railway stations, docks, business circles and other crowded places. However, the self-service fast food vending machine needs food processing, sorting, packaging and heating, and still fails to meet the user requirement of rapidly obtaining the fast food.

SUMMARY OF THE PRESENT INVENTION

Accordingly, an object of the present invention is to provide an automatic food and beverage vending machine for overcoming the failure in immediately providing foods.

Accordingly, in order to accomplish the above objects, the present invention provides an automatic food and beverage vending machine, comprising:

a case;

an ordering and billing system;

an electronic control system; and an output system;

wherein the output system comprises a food provider and a food outlet, the food provider is mounted in a food storage area within the case; the food provider comprises a tray holder, a food box transporter, and a sliding device, the tray holder is mounted on the sliding device, the food box transporter is also mounted on the sliding device; the sliding device comprises an up-down sliding mechanism, a left-right sliding mechanism, and a front-rear sliding mechanism; the food outlet is provided on a door of the case.

Preferably, the sliding device comprises the left-right sliding mechanism, the front-rear sliding mechanism, and the up-down sliding mechanism. The up-down sliding mechanism comprises a first rail, a first rack, a first motor, and a supporter, the first rack and the first rail are vertically mounted inside the case, the first motor is mounted on a side of the supporter, a first gear is mounted on an output shaft of the first motor, the first gear is engaged with the first rack, the supporter is connected to the first rail through a first slider, the supporter comprises a second rack. A second motor is mounted on the left-right sliding mechanism, a second gear is mounted on an output shaft of the second motor, the second gear is engaged with the second rack of the supporter, the left-right sliding mechanism is mounted on the supporter by a second rail and a second slider. The front-rear sliding mechanism is mounted on the left-right sliding mechanism by a third rail and a third slider; the third rail is vertical to the second rail, a third rack is mounted on a bottom side of the third rail, a third motor is mounted on the front-rear sliding mechanism, a third gear is mounted on an output shaft of the third motor, the third gear is engaged with the third rack.

Preferably, the food box transporter comprises a holder, a fourth motor, two steel pulleys cooperating with each other, and a steel tape; the fourth motor and the steel pulleys are mounted on the holder, the fourth motor is connected to one of the steel pulleys through a rotation shaft, the steel tape winds around one of the steel pulleys, a pushing board is mounted on an end of the steel tape, the steel pulleys are engaged with each other through gears.

Preferably, the tray holder is mounted on the front-rear sliding mechanism, a tray is placed on the tray holder, a fourth rail and a fourth rack is mounted at a bottom of the tray, a fifth motor is mounted on the tray holder, a fourth gear is mounted on an output shaft of the fifth motor, the fourth gear is engaged with the fourth rack under the tray.

Preferably, the case comprises a body and the door; both the body and the door comprise an inner tank, a shell, and an intermediate frame; the intermediate frame is placed between the inner tank and the shell, the intermediate frame is formed by welding U-steel and is isolated from the inner tank by a nylon strip; a heat insulating material fills between the inner tank and the shell; the food storage area is provided inside the case, the ordering and billing system is placed on a front surface of the case.

Preferably, the automatic food and beverage vending machine further comprises a beverage storage area and a beverage provider, wherein the beverage storage area is provided on the door; the beverage provider comprises a beverage transporter and a beverage sliding device, the beverage transporter is the same as the food box transporter in structure, the beverage sliding device comprises a fifth rail and a fifth slider, the fifth slider is mounted on the beverage transporter, a sixth motor is mounted on a side of the fifth slider, the fifth rail is vertically mounted on the case, a fifth rack is mounted on a side of the fifth rail, the sixth motor is engaged with the fifth rack, the beverage transporter is connected to a front side of the body through the fifth rail and the fifth slider.

Preferably, at least one layer of tray supporters is mounted on two internal surfaces of the body, the tray supporters are evenly provided in a vertical direction and symmetrically provided in a horizontal direction on the two internal surfaces; the tray is stuck in the tray supporter.

Preferably, the ordering and billing system comprises an LCD displayer, an ordering area, a card area, a banknote area, a coin area, and a change area.

Preferably, the door is hinged to the body.

Preferably, wheels are mounted in four corners of a bottom of the body.

According to the present invention, advantages of the automatic food and beverage vending machine are: a small volume, a small occupation space, convenience of moving, a short time before obtaining the food, a proper food temperature for eating immediately, and a quick manner of dining for people in a hurry.

These and other objectives, features, and advantages of the present invention will become apparent from the following detailed description, the accompanying drawings, and the appended claims.

REFERENCE NUMBERS

Figure 1:
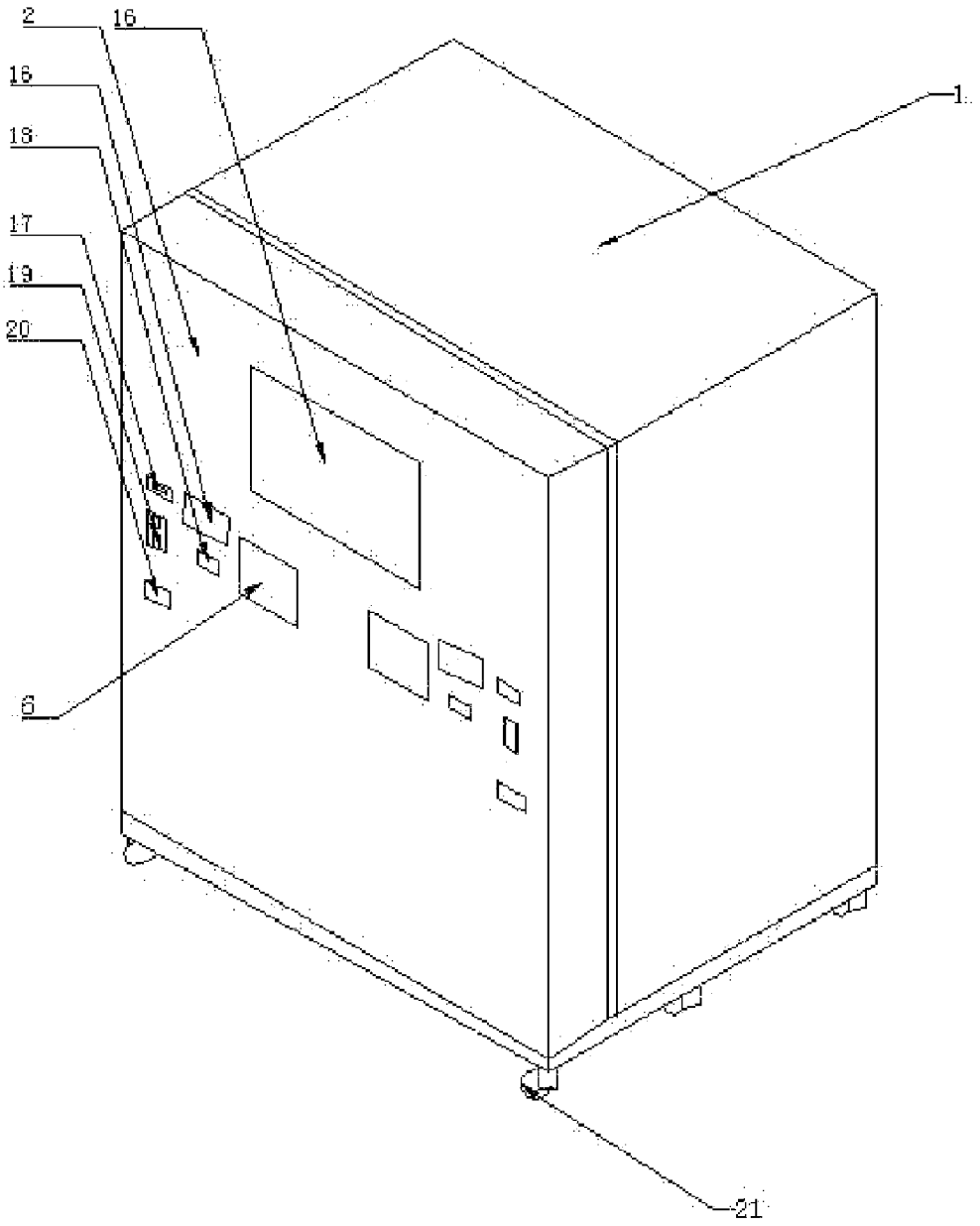
FIG. 1 is a perspective view of an external structure of an automatic food and beverage vending machine according to a preferred embodiment of the present invention.

1—body, 2—door, 3—inner tank, 4—shell, 5—intermediate frame, 6—food outlet, 7—tray holder, 801—first motor, 802—second motor, 803—third motor, 804—fourth motor, 805—fifth motor, 806—sixth, 9—steel pulley, 10—steel tape, 11—pushing board, 12—supporter, 13—tray, 14—beverage transporter, 15—tray supporter, 16—LCD displayer, 17—card area, 18—banknote area, 19—coin area, 20—change area, 21—wheel, 22—ordering area.

DETAILED DESCRIPTION OF THE PREFERRED EMBODIMENT

Referring to the drawings, an automatic food and beverage vending machine according to a preferred embodiment of the present invention is illustrated.

After being electrically supplied, an electronic control system of the automatic food and beverage vending machine is activated, and the automatic food and beverage vending machine is ready to work.

Referring to FIG. 1, the automatic food and beverage vending machine comprises:

a case;

an ordering and billing system; and an output system;

wherein the case comprises a body 1 and the door 2, the door 2 is hinged to the body 1. After the machine is filled with fast foods and beverages, the door 2 is locked on the body 1. The ordering and billing system is placed on a front surface of the case and comprises an LCD displayer 16, an ordering area 22, a card area 17, a banknote area 18, a coin area 19, and a change area 20. A customer views a catalog of the fast foods through the LCD displayer 16, selects desired foods and beverages through the ordering area 22, and pays by card, banknote or coin. That is to say, a variety of payment methods are provided. If the customer pays by banknote or coin, change will be returned to the customer through the change area 20. The output system comprises a food provider, a beverage provider and a food outlet 6. The food provider is mounted in a food storage area inside the case, and the beverage provider is mounted on a side of a beverage storage area on the door 2. The food outlet 6 is mounted on the door 2. After ordering and paying, the food provider obtains the food ordered by the customer, and delivers the food to the food outlet 6 for serving the customer. Similarly, the beverage provider obtains the beverage ordered by the customer, and delivers the beverage to the food outlet 6 for serving the customer.

Figure 2:
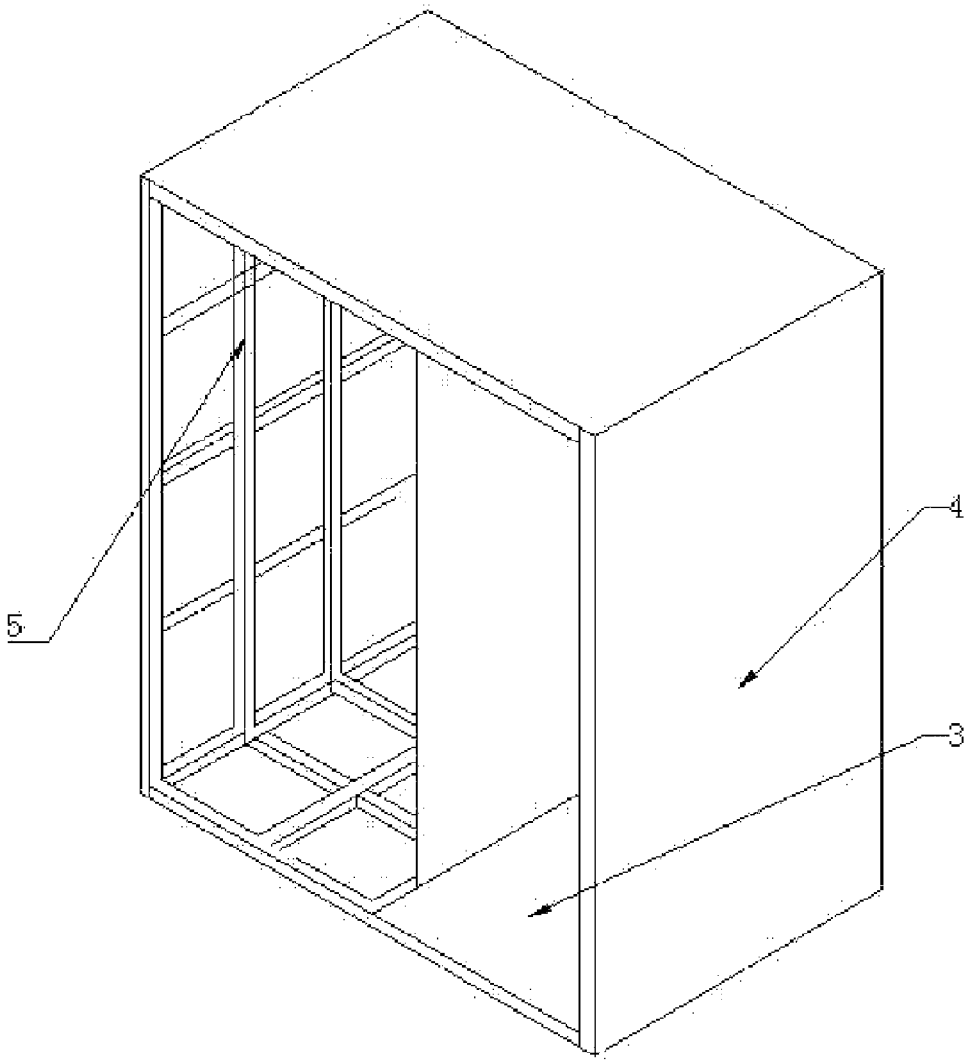
FIG. 2 is a perspective view of a body of the automatic food and beverage vending machine according to the preferred embodiment of the present invention.

Referring to FIG. 2, both the body 1 and the door 2 comprise an inner tank 3, a shell 4, and an intermediate frame 5. The intermediate frame 5 is placed between the inner tank 3 and the shell 4, and supports within a contour of the body 1. The intermediate frame 5 is formed by welding U-steel and is isolated from the inner tank 3 by filling the U-steel with a nylon strip, wherein the nylon strip has a heat insulating function. A heat insulating material fills between the inner tank 3 and the shell 4, wherein the heat insulating material has a heat insulating function. The food and the beverage are provided at different areas inside the case.

Figure 3:
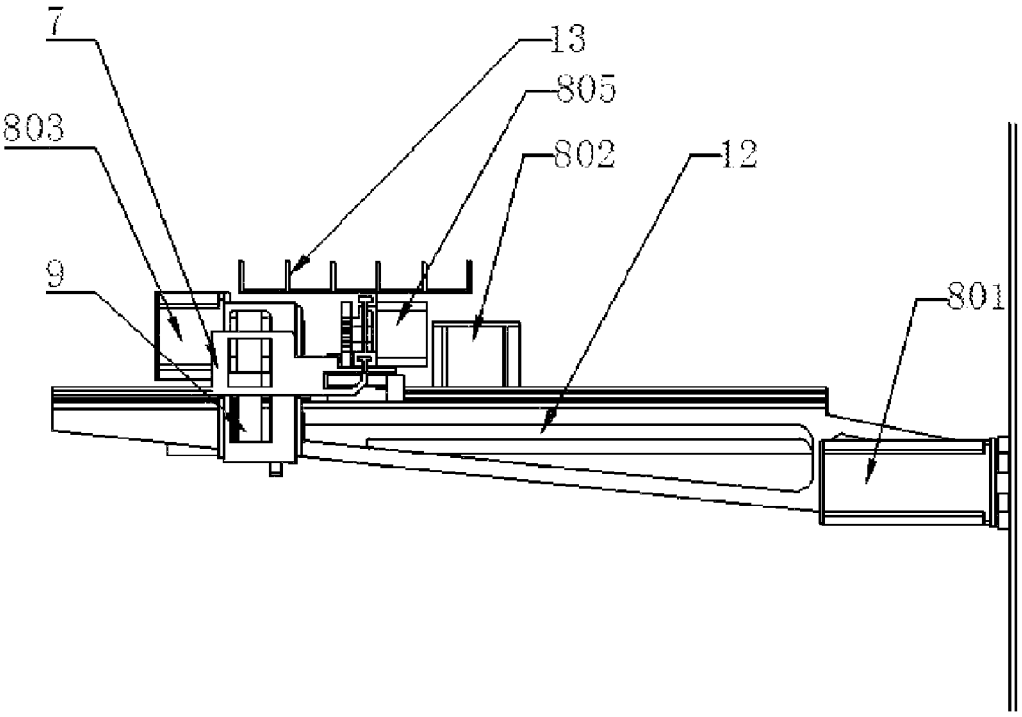
FIG. 3 is a perspective view of a sliding device of the automatic food and beverage vending machine according to the preferred embodiment of the present invention.

Referring to FIG. 3, the food provider comprises a tray holder 7, a food box transporter, and a sliding device, the tray holder 7 is mounted on the sliding device, the food box transporter is also mounted on the sliding device. The tray holder 7 is for providing the food. The food box transporter is for pushing the fast foods forwards if an outermost fast food is sold, in such a manner to prepare next food to be provided. The sliding device is for driving the tray holder 7 and the food box transporter to freely move between layers of different food boxes.

Preferably, the food box transporter comprises a holder, a fourth motor 804, two steel pulleys 9 cooperating with each other, and a steel tape 10. The fourth motor 804 and the steel pulleys 9 are mounted on the holder, the steel tape 10 winds around one of the steel pulleys 9. A pushing board 11 is mounted on an end of the steel tape 10, the steel pulleys 9 are engaged with each other through gears. The fourth motor 804 drives the steel pulleys 9 to stretch out or retract back the steel tape 10, in such a manner that the pushing board 11 pushes the food boxes forwards.

Figure 5:
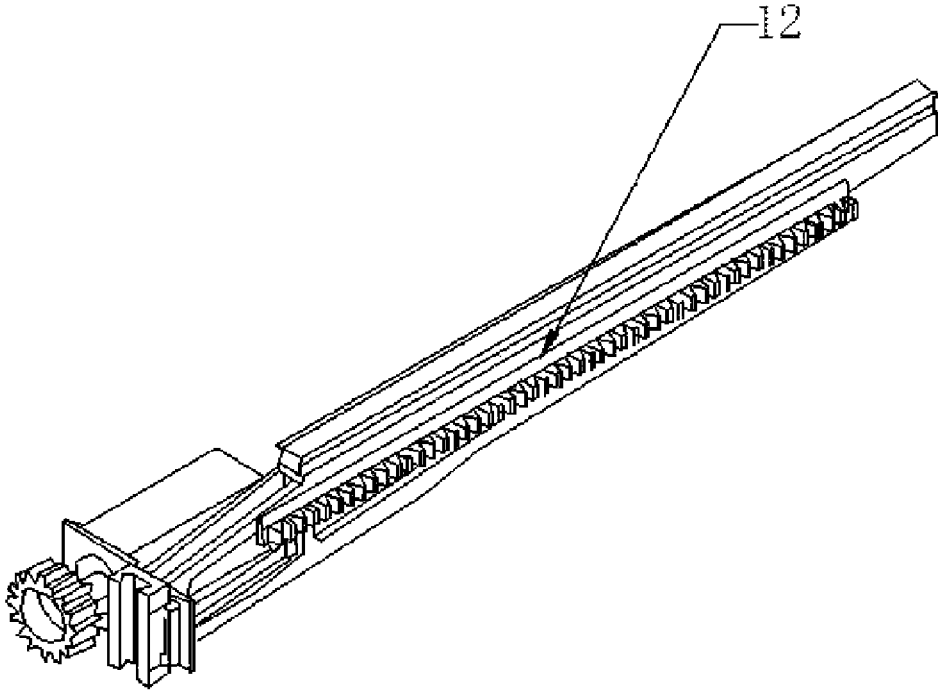
FIG. 5 is a perspective view of a supporter of a front-rear sliding mechanism of the automatic food and beverage vending machine according to the preferred embodiment of the present invention.

Preferably, the sliding device comprises a left-right sliding mechanism, a front-rear sliding mechanism, and an up-down sliding mechanism. Referring to FIG. 5, the up-down sliding mechanism comprises a first rail, a first rack, a first motor 801, and a supporter 12. The first rack and the first rail are vertically mounted at an internal side of the body 1. The first motor 801 is mounted on a side of the supporter 12. A first gear is mounted on an output shaft of the first motor 801. The first gear is engaged with the first rack, and the first motor 801 drives the first gear to rotate, in such a manner to drive the supporter 12 to move up and down on the first rack. The supporter 12 is connected to the first rail through a first slider. The supporter 12 comprises a second rack. A second motor 802 is mounted on the left-right sliding mechanism. A second gear is mounted on an output shaft of the second motor 802, the second gear is engaged with the second rack of the supporter 12. The left-right sliding mechanism is mounted on the supporter 12 by a second rail and a second slider. The second motor 802 drives the second gear to rotate, in such a manner to drive the left-right sliding mechanism to move left and right on the supporter 12. The front-rear sliding mechanism is mounted on the left-right sliding mechanism by a third rail and a third slider. The third rail is vertical to the second rail. A third rack in mounted on a bottom side of the third rail. A third motor 803 is mounted on the front-rear sliding mechanism. A third gear is mounted on an output shaft of the third motor 803. The third gear is engaged with the third rack under the third rail. The third motor 803 drives the third gear to rotate, in such a manner to drive the front-rear sliding mechanism to move front and rear on the left-right sliding mechanism.

Figure 6:
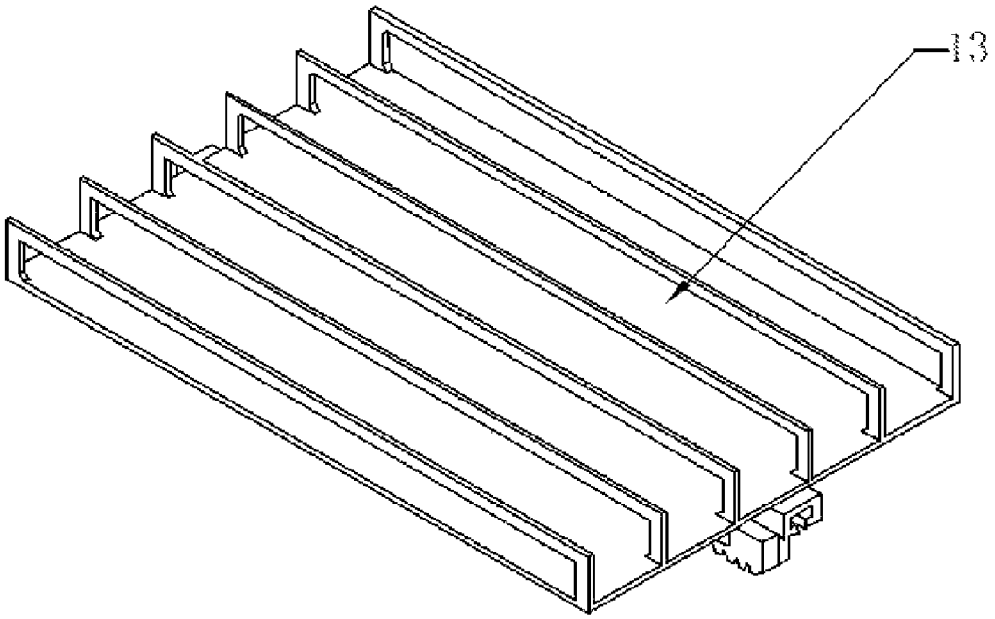
FIG. 6 is a perspective view of a tray of the automatic food and beverage vending machine according to the preferred embodiment of the present invention.

Preferably, the tray holder 7 is mounted on the front-rear sliding mechanism. Referring to FIG. 6, a tray 13 is placed on the tray holder 7; a fourth rail and a fourth rack are mounted at a bottom of the tray 13. A fifth motor 805 is mounted on the tray holder 7, and a fourth gear is mounted on an output shaft of the fifth motor 805. The fourth gear is engaged with the fourth rack. The fifth motor 805 drives the fourth gear to rotate, in such a manner to stretch out or retract back the tray 13. During ordering, the up-down sliding mechanism moves to a layer of the food selected; then the left-right sliding mechanism moves to a row of the food selected; the front-rear sliding mechanism inserts the tray 13 under the food selected and then retracts the tray 13 back; and finally the sliding device delivers the food selected to the food outlet 6 for serving the customer.

Figure 4:
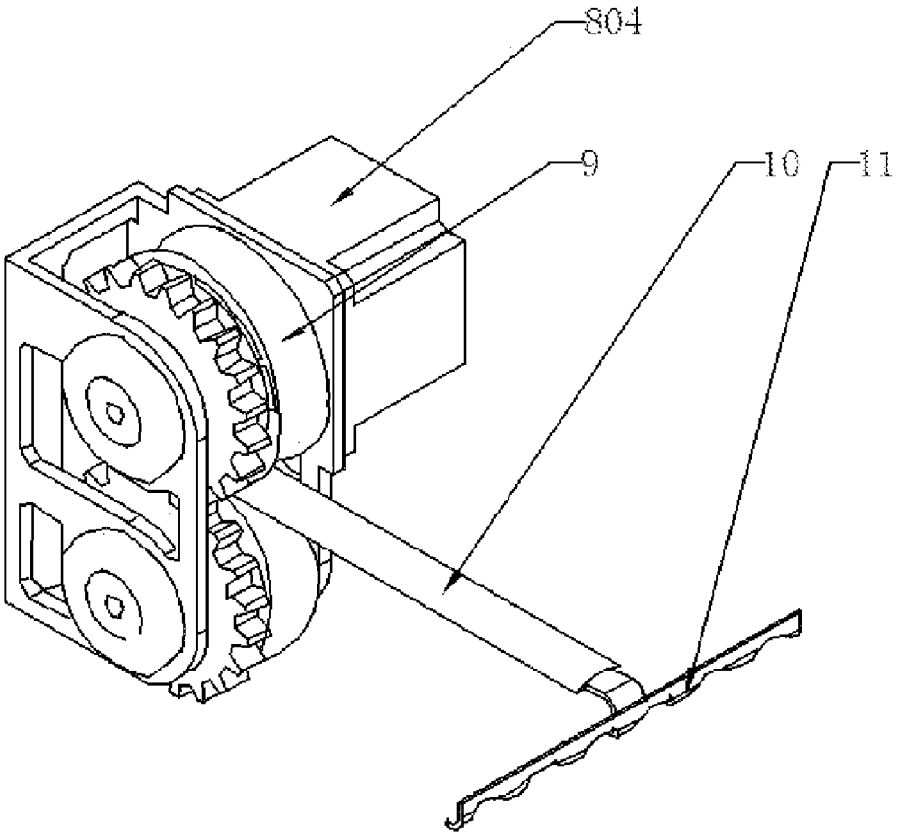
FIG. 4 is a perspective view of a beverage transporter and a food box transporter of the automatic food and beverage vending machine according to the preferred embodiment of the present invention.

Preferably, the beverage provider comprises a beverage transporter 14 and a beverage sliding device. Referring to FIG. 4, the beverage transporter 14 is the same as the food box transporter in structure. The beverage sliding device comprises a fifth rail and a fifth slider, wherein the fifth slider is mounted on the beverage transporter 14. A sixth motor 806 is mounted on a side of the fifth slider. The fifth rail is vertically mounted on the body 1, and a fifth rack is mounted on a side of the fifth rail. The sixth motor 806 is engaged with the fifth rack. The beverage transporter 14 is connected to a front side of the body 1 through the fifth rail and the fifth slider, and moves up and down. When the customer buys a beverage, the fifth slider drives the beverage transporter 14 to move to a layer of the beverage selected, and the beverage sliding device drives the tray 13 to move to a bottom of the beverage transporter 14; the beverage transporter 14 pushes the beverage selected out and the beverage selected drops onto the tray 13; then the beverage sliding device drives the tray 13 to deliver the beverage selected to the food outlet 6 for serving the customer.

Figure 7:
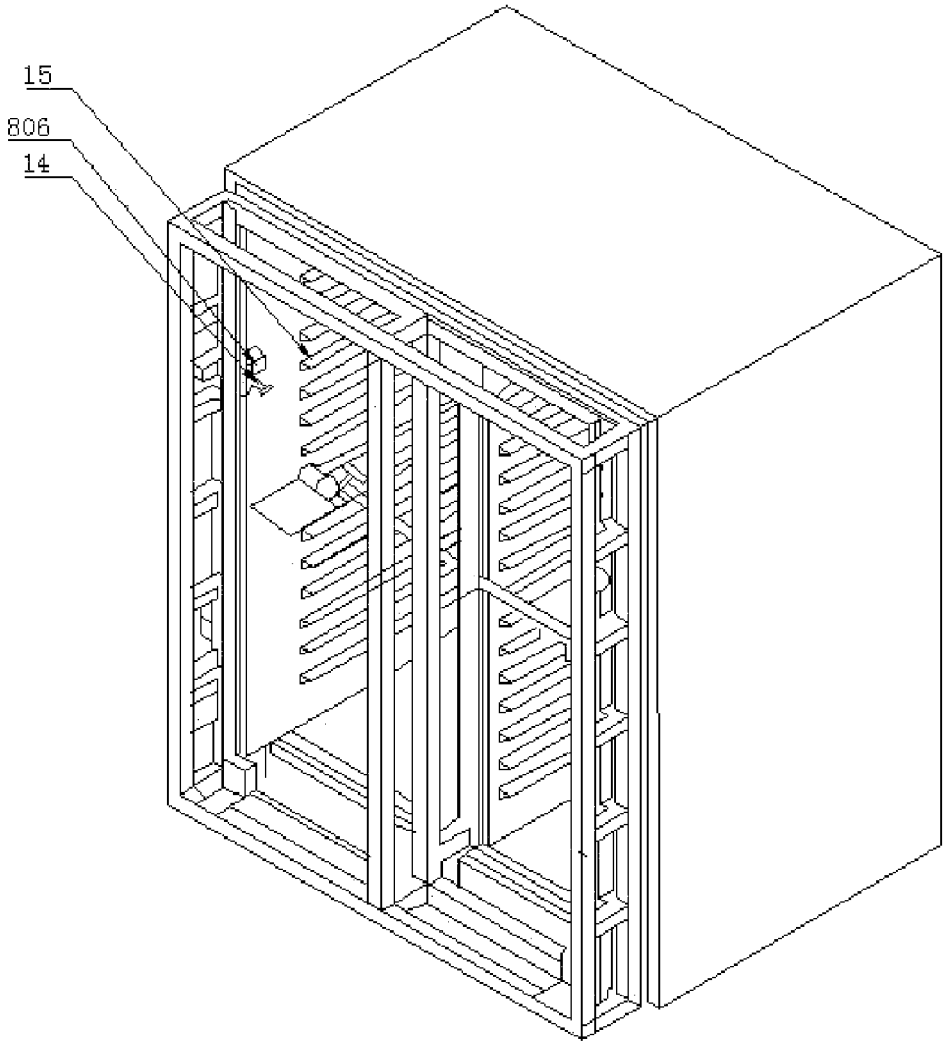
FIG. 7 is a perspective view of an internal structure of the automatic food and beverage vending machine according to the preferred embodiment of the present invention.

Referring to FIG. 7, at least one layer of tray supporters 15 is mounted on two internal surfaces of the body 1. The tray supporters 15 are evenly provided in a vertical direction and symmetrically provided in a horizontal direction on the two internal surfaces; the tray 13 is stuck in the tray supporter 15.

Referring to FIG. 1, wheels 21 are mounted in four corners of a bottom of the body 1, so as to facilitate moving and transporting the automatic food and beverage vending machine.

One skilled in the art will understand that the embodiment of the present invention as shown in the drawings and described above is exemplary only and not intended to be limiting. Therefore, this invention includes all modifications encompassed within the spirit and scope of the following claims.

What is claimed is:

1. An automatic food and beverage vending machine, comprising:

a case;

an ordering and billing system;

a food storage area;

an electronic control system; and an output system;

wherein said output system comprises a food provider and a food outlet, said food provider is mounted inside said case and between said food storage area and said food outlet; said food provider comprises a tray holder, a food box transporter, and a sliding device, said tray holder is mounted on said sliding device, said food box transporter is also mounted on said sliding device; said sliding device comprises an up-down sliding mechanism, a left-right sliding mechanism, and a front-rear sliding mechanism; said food outlet is provided on a door of said case;

wherein said sliding device comprises said left-right sliding mechanism, said front-rear sliding mechanism, and said up-down sliding mechanism;

wherein said up-down sliding mechanism comprises a first rail, a first rack, a first motor, and a supporter, said first rack and said first rail are vertically mounted inside said case, said first motor is mounted on a side of said supporter, a first gear is mounted on an output shaft of said first motor, said first gear is engaged with said first rack, said supporter is connected to said first rail through a first slider, said supporter comprises a second rack; a second gear is mounted on an output shaft of a second motor, said second gear is engaged with said second rack of said supporter;

wherein said left-right sliding mechanism is mounted on said supporter by a second rail and a second slider;

wherein said front-rear sliding mechanism is mounted on said left-right sliding mechanism by a third rail and a third slider; said third rail is vertical to said second rail, a third rack in mounted on a bottom side of said third rail, a third motor is mounted on said front-rear sliding mechanism, a third gear is mounted on an output shaft of said third motor, said third gear is engaged with said third rack;

wherein said tray holder is mounted on said front-rear sliding mechanism, a tray is placed on said tray holder, a fourth rail and a fourth rack is mounted at a bottom of said tray, a fifth motor is mounted on said tray holder, a fourth gear is mounted on an output shaft of said fifth motor, said fourth gear is engaged with said fourth rack under said tray.

2. The automatic food and beverage vending machine, as recited in claim 1, wherein said case comprises a body and said door; both said body and said door comprise an inner tank, a shell, and an intermediate frame; said intermediate frame is placed between said inner tank and said shell, said intermediate frame is formed by welding U-steel and is isolated from said inner tank by a nylon strip; a heat insulating material fills between said inner tank and said shell; said food storage area is provided inside said case, said ordering and billing system is placed on a front surface of said case.

3. The automatic food and beverage vending machine, as recited in claim 1, further comprising a beverage storage area and a beverage provider, wherein said beverage storage area is provided on said door; said beverage provider comprises a beverage transporter and a beverage sliding device, said beverage transporter is the same as said food box transporter in structure, said beverage sliding device comprises a fifth rail and a fifth slider, said fifth slider is mounted on said beverage transporter, a sixth motor is mounted on a side of said fifth slider, said fifth rail is mounted on said case, a fifth rack is mounted on a side of said fifth rail, said sixth motor is engaged with said fifth rack, said beverage transporter is connected to a front side of a body of said case through said fifth rail and said fifth slider.

4. The automatic food and beverage vending machine, as recited in claim 2, further comprising a beverage storage area and a beverage provider, wherein said beverage storage area is provided on said door; said beverage provider comprises a beverage transporter and a beverage sliding device, said beverage transporter is the same as said food box transporter in structure, said beverage sliding device comprises a fifth rail and a fifth slider, said fifth slider is mounted on said beverage transporter, a sixth motor is mounted on a side of said fifth slider, said fifth rail is mounted on said case, a fifth rack is mounted on a side of said fifth rail, said sixth motor is engaged with said fifth rack, said beverage transporter is connected to a front side of said body through said fifth rail and said fifth slider.

5. The automatic food and beverage vending machine, as recited in claim 4, wherein at least one layer of tray supporters is mounted on two internal surfaces of said body, said tray supporters are evenly provided in a vertical direction and symmetrically provided in a horizontal direction on said two internal surfaces; said tray is stuck on said tray supporter.

6. The automatic food and beverage vending machine, as recited in claim 5, wherein said ordering and billing system comprises an LCD displayer, an ordering area, a card area, a banknote area, a coin area, and a change area.

7. The automatic food and beverage vending machine, as recited in claim 6, wherein said door is hinged to said body.

8. The automatic food and beverage vending machine, as recited in claim 7, wherein wheels are mounted in four corners of a bottom of said body.

* * * * *